United States Patent [19]

Taylor

[11] 4,077,632

[45] * Mar. 7, 1978

[54] LINED FACE FOR A GOLF CLUB

[76] Inventor: David L. Taylor, 380 W. Carmel Valley Rd., Carmel Valley, Calif. 93924

[ * ] Notice: The portion of the term of this patent subsequent to Sep. 7, 1990, has been disclaimed.

[21] Appl. No.: 736,065

[22] Filed: Oct. 27, 1976

[51] Int. Cl.[2] ..... A63B 53/04

[52] U.S. Cl. ..... 273/164; 273/167 J

[58] Field of Search ..... 273/77 R, 164, 167–175, 273/183 D, 163 R; D34/5 GH

[56] References Cited

U.S. PATENT DOCUMENTS

| | | | |
|---|---|---|---|
| D. 90,924 | 10/1933 | Replogle | D34/5 GH |
| D. 96,478 | 8/1935 | Jansky | D34/5 GH |
| D. 156,963 | 1/1950 | Johnson | D34/5 GH |
| D. 167,941 | 10/1952 | Jamison | D34/5 GH |
| D. 179,002 | 10/1956 | Hoffmeister | 273/164 X |
| D. 180,602 | 7/1957 | Karns | 273/164 X |
| D. 204,466 | 4/1966 | Sowers | 273/164 X |
| D. 241,359 | 9/1976 | Taylor | 273/164 X |
| 1,485,272 | 2/1924 | Kinsman | 273/164 |
| 2,212,651 | 8/1940 | Sanderson | 273/163 R X |
| 2,842,369 | 7/1958 | East | 273/164 |
| 2,865,635 | 12/1958 | Jessen | 273/163 R X |

FOREIGN PATENT DOCUMENTS

| | | | |
|---|---|---|---|
| 243,435 | 11/1925 | United Kingdom | 273/164 |
| 310,209 | 4/1929 | United Kingdom | 273/77 R |

*Primary Examiner*—Richard J. Apley

[57] ABSTRACT

A head for a golf club which presents vertical "toned" stripes on the striking face thereof, which stripes extend upward and over the top surface of the club head continuously from the striking face. The stripes are alternate in tone and are substantially equidistant from each other. The alternate stripes cover a substantial area of the striking face. The vertical stripes are not grooves, and they do not change the character of the striking face in any way which could influence the flight of the golf ball. The stripes are intended to indicate to the player the proper direction to the target, in the event he is unable to determine the correct line because the lower edge of the golf club face is obstructed from his vision due to the nature of the lie of the ball.

4 Claims, 3 Drawing Figures

LINED FACE FOR A GOLF CLUB

BACKGROUND OF THE INVENTION

In playing the game of golf, when making a stroke from a difficult lie — and particularly in the rough, where one is able to ground the golf club, the nature of the surface in which the ball has come to rest will obscure the lower edge of the striking face of the club. When the player is unable to clearly see the lower edge of the club head, he is unable to determine the proper position of the head to make the stroke to the best advantage. So far as one has been able to ascertain, there has been no effective aid for the amateur as well as the professional golfer, in aligning the shots under such circumstances. The professional also would like better control of shots from the deep rough, where direction of flight of the ball contributes greatly to the success of the shot.

SUMMARY OF THE INVENTION

The golf club head described herein provides the optical aids for accurately aligning the stroke with respect to the target, where the lower edge of the striking face canot be observed by the player. While there are many clubs which have a large portion of the striking face provided with spaced grooves cut into the face, or punch markings therein, for better contact with the ball, these markings do not serve as a means for aligning the lower edge of the golf club head, and in no instance has there been any suggestion that the horizontal grooves or punch marks contribute anything to the alignment of the club head with respect to the target.

In designing a golf club head, one has to be extremely careful in providing a head which will be legal for use under the rules of the USGA. Careful consideration of the rules has, of course, a material effect upon the economic value of the golf club. Most of the private and public golf clubs adhere to the rules of the USGA for their standards of play. It would be neither practical nor economical to provide a golf club head which would not conform to those rules. Accordingly, every effort has been made in this instance to adhere to and conform with the rules of the USGA. The golf club head described herein complies in every respect with Rule 2, 2(*d*), and the Specifications for markings on club heads as promulgated by the U.S. Golf Association.

Surprisingly the use of a multiplicity of spaced parallel stripes brings about precision alignment. The stripes are wide enough and regularly spaced in a contrasting tone to make this precision available to the golfer at all times regardless of his game proficiency. Such parallel stripes over the greatest area of the face possible under the USGA Rules, provide more accurate alignment than a single line or groove whether accompanied by lines at either side or not.

In addition to the extension or continuation of the tone lines over the top edge of the club head brings another dimension to its usefulness. As will be noted, as the face of the club head becomes more vertical, the striking face itself becomes less visable to the player. By continuing the toned stripes of the face over the top edge, the advantage of the striped face become available to all iron clubs, even up to the number one iron. This result is wholly unexpected and unique.

It has been discovered that a multiplicity of parallel regularly speced stripes over a large area of a club face are a great aid in the proper alignment of the striking face, and far better than anything disclosed in the prior art. Simply stated, it is easier to align the parallel stripes with the path to the target than by any other known method.

Further objects are to provide a construction of maximum simplicity, economy, and ease of manufacture, also such further objects, advantages and capabilities as will fully appear and as are inherently possessed by the device and the invention described herein.

Invention further resides in the combination, construction and arrangement of parts illustrated in the accompanying drawings, and while there is shown therein a preferred embodiment thereof, it is to be understood that the same is merely illustrative of the invention and that the invention is capable of modification and change, and comprehends other details of construction without departing from the spirit thereof or the scope of the appended claims.

DESCRIPTION OF PREFERRED EMBODIMENTS

Figure 1:
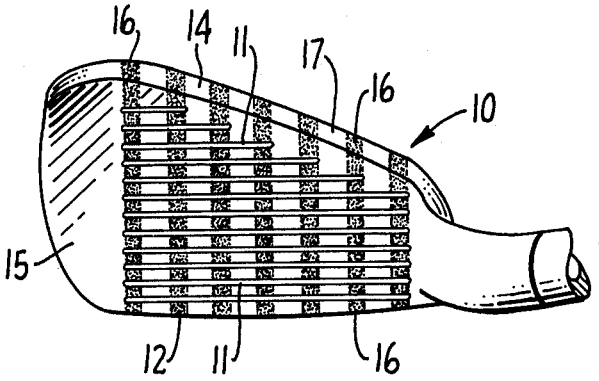
FIG. 1 is a plan view from a vertical position of a highly lofted golf club head.

Referring now more particularly to the drawing in which like reference numerals indicate like parts in the several views, there is indicated generally at 10 of golf club head. Although the head shown in the drawing is that of a highly lofted iron golf club, such as a nine iron or pitching wedge, it is to be understood that the invention is applicable to all golf clubs including both woods and irons. The surface of the face of a club, particularly the irons, is largely dictated by the general rules of USGA Rule 2 and the specifications which explain the rules more elaborately. It is to be noted that the shape of the head and the relative portions therein vary from time to time and from one manufacturer or maker to another. However this may be, the shape or outline of the face of the head is not to be considered a part of this invention.

Figure 2:
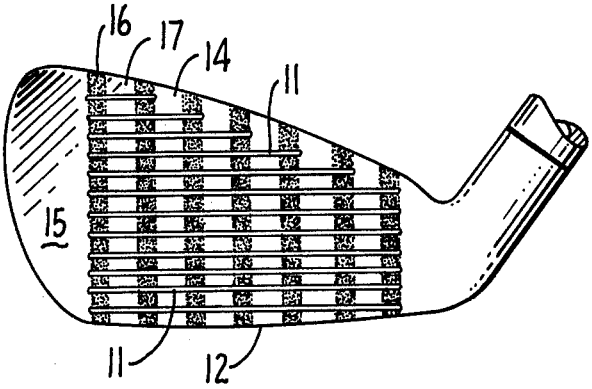
FIG. 2 is a front elevational view of the golf club head shown in FIG. 1.

In FIGS. 1 and 2 there is shown a series of lateral grooves 11 which are cut into the face of the club in substantially a horizontal direction. Such grooves are permitted by the USGA. The Rules and Specifications provide that the grooves shall not exceed a width of 0.035 inches and shall not be greater than a depth greater than their width. The grooves must be angled inwardly at a 45° angle from a vertical plane normal to the striking face of the club. Furthermore, the rules provide that the distance between the grooves shall be less than three times the width of the grooves themselves. It may be assumed, therefore that the grooves 11 shown in FIGS. 1 and 2 comply with the rules and specifications of The USGA.

As is also shown in the drawing, the lower edge 12 of the club head 10 is usually a straight horizontal line, although this may vary from time to time and may not be parallel to the grooves 11. However, it may be assumed for purposes here that the lower edge 12 represents a line which is parallel to level ground.

The upper edge 14 of the club head represents the strength of the material of the club head at that particular location. This surface may be wide or narrow, depending upon the nature of the club involved, but represents an area which is always visible to the golfer.

The face 15 of the club head 10 is provided with vertical stripes 16 which are parallel one to the other and cover nearly the entire face of the club. The stripes 16 are equally spaced by unmarked stripes 17 which may be the same width as the stripes 16 but are preferably a little wider. The stripes 16 are darkened or toned to contrast with the stripes 17 of the club face and provide a contrast which may be readily apparent. The stripes 16 are darkened in such a manner that they do not provide ay indentation or raising of the surface or in any other way which would interfere with or influence the flight of a golf ball struck by the club face. The USGA Rules provide Rule 2-2*d:*

"Club faces shall not have any lines, dots or other marks with sharp or rough edges or any type of finish, for the purpose of unduly influencing the movement of the ball. Markings on the face of the club shall conform with the specifications."

To be in full compliance with the rules, the stripes 16 are preferably accomplished by a treatment of the surface which in no way leaves ridges, indentations or dots which would influence the flight of a golf ball. The stripes 16 are in no way comparable to the horizontal grooves 11 and do not cut into or lay on top of this surface 15 of the face of the club, in embossed condition.

Figure 3:
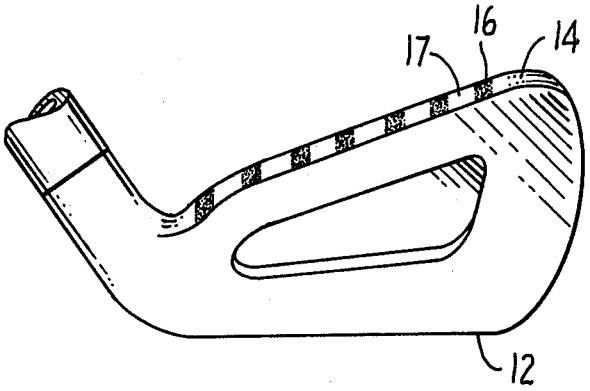
FIG. 3 is a rear elevational view of the golf club head shown in FIG. 1.

It is to be noted especially with respect to FIGS. 1 and 3 that the stripes 16 carry the contrast over the top edge 14 so that the strikes are continuous extensions from the face of the club over the top edge 14. This feature is unique.

OPERATION

It is believed that the descriptions and the drawings completely illustrate the manner and use and the purposes of the club head 10.

Where a golf club may be grounded in making the stroke, it may be readily understood if the ball has come to rest in the rough, or in some other unattended area, it is readily understood that the lower edge 12 of the club head may be, and usually is, obsured from the player's vision. Since it is the lower edge 12 of the club head which is used to determine the direction of the stroke and since it is not safe to rely upon the grooves 11, the player cannot properly line up the club head to determine the precise direction to the target.

In the use of the club head described herein, the vertical stripes 16 are always at right angles with respect to the ground surface regardless of the shape of the head and when the club head is angled sufficiently some portions thereof are always visible to the golfer. The player by observing the direction of the vertical stripes 16 is always able to line up a shot with respect to the intended target. If the club head is of steeper angle so that the face is not readily within the vision of the golfer then the continuation of the stripes 16 over the top edge 14 furnish the same reliability for lining up the club head properly in the direction of the intended target.

Thus it appears that all of the advantages of this type of club head are accomplished and that other advantages provided by experience in the use of this club head will readily demonstrate themselves in the acquisition of such experience.

I claim:

1. A head for a golf club having a striking face and a top surface, spaced vertical stripes over more than one-half of the area of said striking face, said stripes continuing contiguously across the top surface of said head.

2. The golf club head of claim 1 wherein the stripes are alternate and toned without thereby changing the character of the striking face in any way which could influence the flight of the golf ball in making a stroke, wherein the stripes are normal to the lower edge of said striking face.

3. An iron golf club having a head as claimed in claim 2 wherein the stripes on said striking face are at right angles to the ground.

4. An iron golf club head, spaced uniform vertical stripes of substantial width over a substantial area of the striking face, said stripes being separated by a distance slightly greater than their width, and continuously extending across the top surface of said club head, said stripes on said striking face being at right angles to the horizontal represented by the ground.

* * * * *